US005147567A

United States Patent [19]

Agarwala et al.

[11] Patent Number: 5,147,567

[45] Date of Patent: Sep. 15, 1992

[54] SYNTHETIC LUBRICATING OIL GREASES CONTAINING METAL CHELATES OF SCHIFF BASES

[75] Inventors: Vinod S. Agarwala, Warminster; Alfeo A. Conte, Jr., Warrington, both of Pa.; Krishnaswamy S. Rajan, Elmhurst; Prabir K. Sen, Skokie, both of Ill.

[73] Assignee: The United States of America as represented by the Secretary of the Navy, Washington, D.C.

[21] Appl. No.: 700,373

[22] Filed: Apr. 9, 1971

[51] Int. Cl.[5] ..... C10M 105/80

[52] U.S. Cl. ..... 252/42.7; 252/50; 252/51.5 R

[58] Field of Search ..... 252/51.5 R, 42.7, 50

[56] References Cited

U.S. PATENT DOCUMENTS

| | | | |
|---|---|---|---|
| 2,282,513 | 5/1942 | Downing | 252/51.5 R |
| 2,409,799 | 10/1946 | Roberts | 252/50 |
| 2,420,953 | 5/1947 | Hunt | 252/50 |
| 3,192,161 | 6/1965 | Wistosky | 252/50 |
| 3,398,170 | 8/1968 | Cyba | 252/42.7 |
| 3,412,029 | 11/1968 | Andress | 252/51.5 R |

*Primary Examiner*—Prince Willis, Jr.
*Assistant Examiner*—Thomas Steinberg
*Attorney, Agent, or Firm*—James V. Tura; James B. Bechtel; Susan E. Verona

[57] ABSTRACT

This invention relates to a method and composition for improving the corrosion resistance and anti-wear properties of synthetic lubricating oil greases comprising the addition to said greases of effective amounts of a chelated Schiff base derived from the condensation of approximately stoichiometic amounts of at least one aldehyde and a polyamine.

8 Claims, 2 Drawing Sheets

SYNTHETIC LUBRICATING OIL GREASES CONTAINING METAL CHELATES OF SCHIFF BASES

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

Naval aircraft and related equipment operate in an environment which is unique in that the load carrying surfaces such as bearings, splines, gears and alike in addition to experiencing wear under normal operating conditions, must also function in a highly corrosive environment. This requirement places substantial burden on the lubricating additives that must function as a corrosion inhibitor and as an extreme pressure agent under severe environmental conditions and at times at relatively high temperatures. Problems relating to corrosion and wear have in the past been treated as separate problems whereas in reality corrosion and wear resistance are primarily surface sensitive requirements. Accordingly, there is substantial interest in lubricating additives which exhibit corrosion resistance and at the same time improve the wear resistance under extreme environmental and operating conditions.

Presently, there is no single lubricating additive which functions both as an anti-wear (lubricating agent) and a corrosion-inhibiting additive. Some of the known lubricants including the solid lubricants such as molybdenum disulfide is known to hydrolyse forming acidic components which readily attack metal causing corrosion. Similarly graphite, although known as a dry lubricant, is capable of forming a galvanic cell with bearing metals and acts as a cathode thereby resulting in corrosion. The lubricating additives of this invention, however, were found not only to inhibit corrosion but also to have the unique capability of performing as an anti-wear agent in various grease compositions. The additives of this invention are very useful for military purposes, and can be used in lubricants in high performance engines and particularly for aircraft which have sophisticated bearings, gears and other working parts. These engines are required to perform at substantially higher loads and speeds, and at higher temperatures thereby reducing the life of the lubricants.

A substantial increase in the life of a bearing by improving the lubricant, for example, will not only reduce the high maintenance cost due to down time, which is critical in both commercial and military aviation, but is useful also in the auto industry which is continually trying to improve petroleum products, particularly for its super-charged engines which require hihger operating temperatures and increased loads. These high temperatures and loads require the bearings, for example, to operate under substantially more demanding conditions. Therefore, it was unexpected to find substantial improvement by using the Schiff base compounds of this invention as additives in greases in machinery aboard ship, submarines and particularly in the aircraft industry.

More specifically, studies have shown that there is a unique relationship between wear and corrosion and that the enhancement of passivity or build-up of corrosion resistance also significantly reduces wear. Presently, solid lubricants such as molybdenum disulfide, graphite and alike are primarily used as lubricating additives at elevated temperatures under extreme loads. However, these dry lubricants while improving the load and extreme pressure qualities of the lubricant do not have any intrinsic corrosion-inhibiting characteristics. As indicated herein, molybenum disulfide hydrolyzes to form acidic components which readily attack the metal causing corrosion. Similarly, graphite is an electro-chemically noble material and is therefore known to form galvanic cells with bearing metals in the presence of moisture or any ionic medium causing corrosion. Other known compounds such as chromates, sulfonates, molybdates, nitrites and alike are known to inhibit corrosion only under certain conditions. Moreover, while some of these compounds improve the corrosion protection of a particular lubricant, these same compounds do not, however, improve the wear characteristics of the lubricant under extreme pressure and at higher temperatures.

SUMMARY OF THE INVENTION

This invention relates to a synthetic lubricating oil grease having improved corrosion resistance and anti-wear properties. More specifically, the invention relates to the addition of effective amounts of a Schiff-base compound derived from the reaction of at least one aldehyde and a polyamine to synthetic lubricating oil greases to improve the corrosion resistance and anti-wear characteristics.

Accordingly, it is an object of this invention to provide a method of improving the corrosion resistance and anti-wear properties of lubricating oil greases derived from synthetic oils. It is another object of this invention to provide novel lubricating oil greases capable of functioning at high temperatures and under extreme pressures. It is still a further object of this invention to provide a method of preparing lubricating oil greases having improved corrosion resistance and anti-wear properties.

IN THE DRAWINGS

DETAILED DESCRIPTION OF THE INVENTION

It was found, in accordance with this invention, that Schiff bases possess the unique characteristic of improving both anti-wear and corrosion inhibition properties of a lubricant. The Schiff base compounds are derived from the reaction or condesation of organic carbonyl compounds i.e. aldehydes and ketones with polyamines. The term Schiff base includes all the reaction products derived from an aldehyde and a polyamine and the metal chelates of said products such as the copper chelates, etc. The preferred products are derived from the reaction of an aromatic aldehyde such as salicylaldehyde and a diamine such as benzidine. This particular reaction product is characterized as a bis- salicylaldehyde having a melting point at about 264° C. These reaction products can be added to a variety of lubricants and particularly lubricating oil greases in amounts ranging up to about five percent (5%) by weight of the total composition. Lubricants containing the Schiff bases have been found to have a longer life and improved corrosion protection in comparison to the same lubricants without the Schiff base products. For example, the addition of five percent by weight of the product (Schiff-base) obtained from the reaction of salicylaldehyde and benzidine to a oil grease derived from a perfluoroalkylpolyether provided an eight fold increase in bearing performance as compared to the same grease without the Schiff base product.

Figure 1:
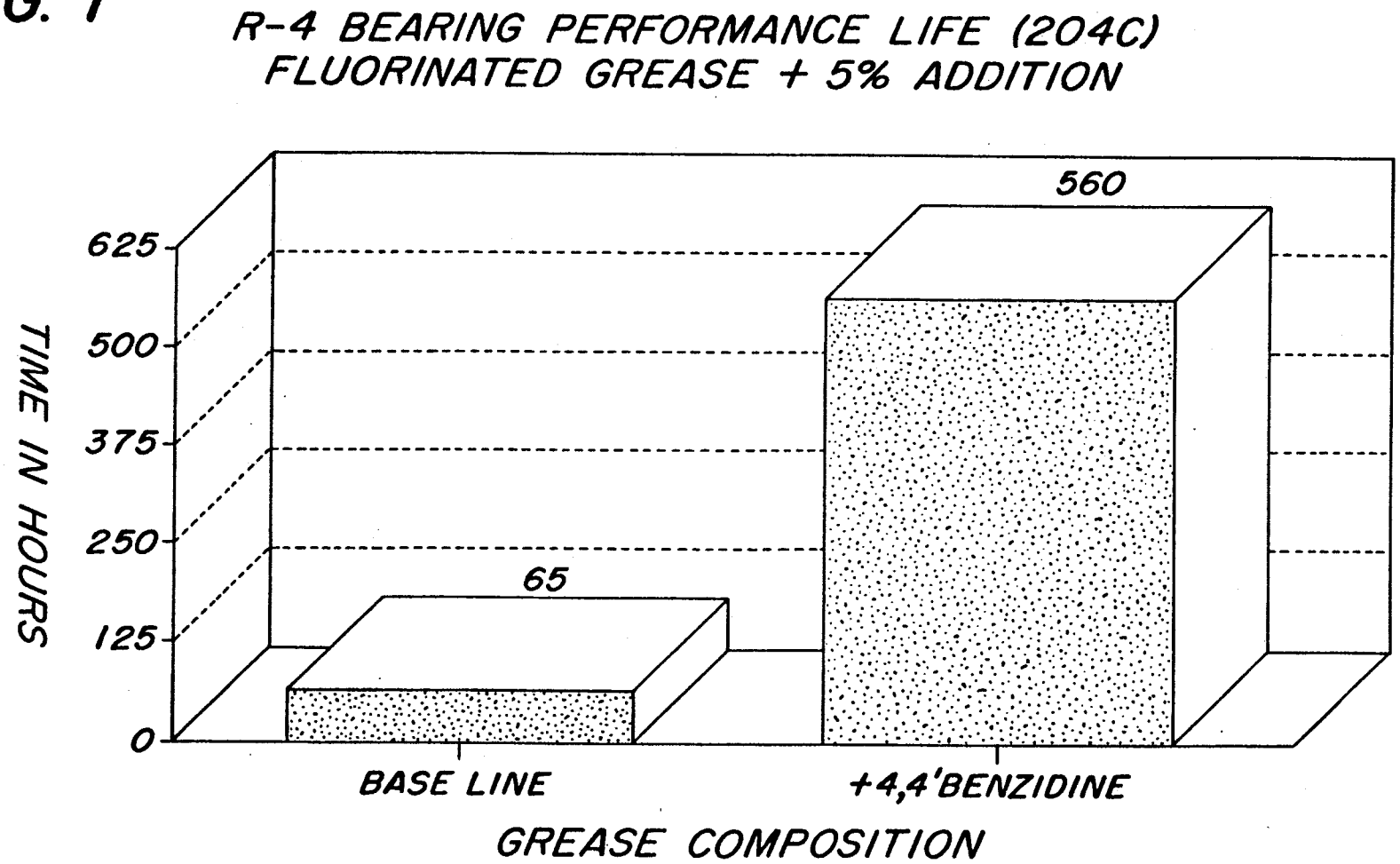
FIG. 1 is a bar graph showing the improvement of the Schiff base in a grease with respect to the life of the bearings.
Figure 2:
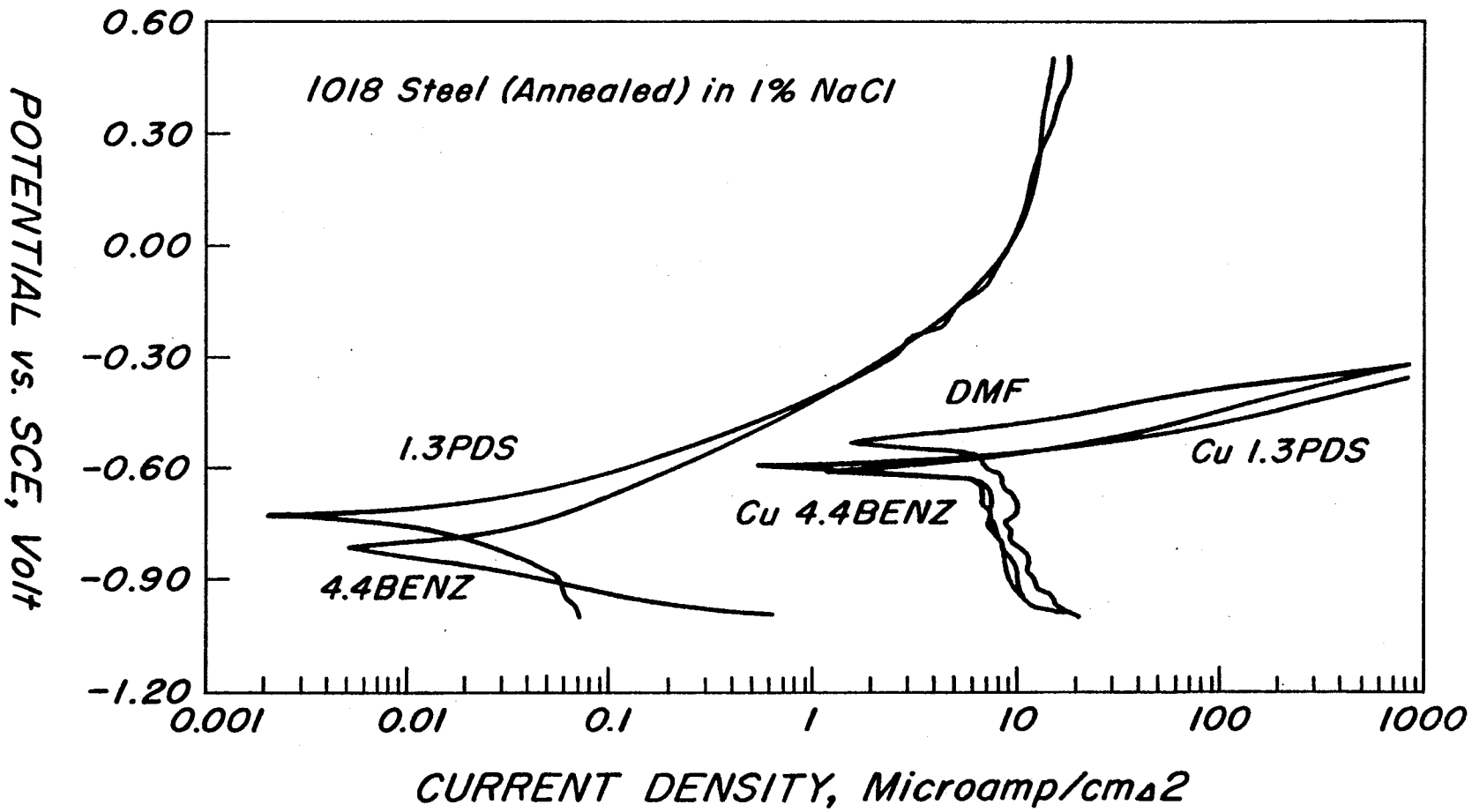
FIG. 2 is a plot of the current density and potential vs. SCE, Volt which shows the effect of Schiff base, dissolved in DMF and dispersed in 1% NaCl solution, on electrochemical polarization behavior of steel.

The greases were tested, in accordance with ASTM Standard Method D-33/37 entitled "Evaluation of Greases in Small Bearings". As shown in FIG. 1, this particular test was carried out under an R-4 size stainless steel bearings at 2.2 radial load, 22 axial load, at 12,000 rpm and at 204° C. The data in FIG. 1 shows that the addition of the Schiff base to the grease substantially improves the life of the bearings. Moreover, the electrochemical polarization curves as shown in FIG. 2, generated under controlled laboratory conditions, indicates that less than 0.001 mole of the Schiff base compound in 1% sodium chloride solution protected a 10/10 steel by decreasing the anodic and cathodic currents by at least three orders of magnituted. This translates into lowering the corrosion rates by the same order of magnitude.

This invention is directed specifically to Schiff base compounds as corrosion and wear-resistant additives for lubricating compositions i.e. synthetic lubricating oil greases useful at high temperatures, i.e., ranging up to 250° C. It was found that the planner structure and quadridentate metal-binding characteristics of these compounds are similar to those of the macrocyclic compounds such as the phthalocyanines and porphyrins. Lubricating compositions containing effective amounts of the Schiff base compounds were tested for their corrosion inhibition and wear resistance using an especially designed high speed bearing test unit.

While a large variety of synthetic oils including the polyethers, polyesthers, silicones, siloxanes i.e. silicone esters and fluorinated esthers, etc. have been investigated with various solid lubricants e.g. molybdenum disulfide, graphites, etc., a critical review of these lubricants at high temperatures has indicated that little research has been conducted with the Schiff bases in high temperature greases.

For comparison purposes, the compounds set forth in Table I were selected for the test. The compounds were subjected to thermal and oxidative stability test to determine the corrosion and wear resistant properties.

TABLE I

"Thermally Stable" Compounds

Chemical Description

1. Schiff base derived from salicylaldehyde and ethylenediamine
2. Schiff base derived from salicylaldehyde and benzidine
3. Schiff base derived from salicylaldehyde and 1,3-phenylenediamine
4. Cu (II) chelate of bissalicylaldehyde-ethylenediamine
5. Cu (II) chelate of bissalicylaldehyde-1,3-phenylene diamine
6. Phthalocyanine
7. Copper (II) phthalocyanine
8. Mesotetraphenyl porphyrin The test compounds were exposed in a box furnance to slowly flowing air at a temperature of 200° C. for varying periods of time, i.e., ranging from about 16 to 1000 hours. The compounds which did not suffer appreciable weight loss, i.e. greater than 30 percent during the initial 16 hour test period were continued to be heated in the furnace for a total of 48, 250 and up to 1000 hours. As a result of the thermal oxidation test, these were the only compounds found to be thermally and oxidatively stable i.e. upon heating at 200° C. for 1000 hours. The compounds were tested in primarily two types of oils identified as polydimethoxy siloxane polymers and Krytox CPC oil (homopolymer of hexaflauoroethylene epoxide). These oils are thermally stable at 200° C. Generally, the lubricating compositions were prepared by blending effective amounts of the compounds with the base oils preheated to 150° C. The lubricating greases tested are set forth in Table II.

TABLE II

| | Lubricant Formulations | | | |
|---|---|---|---|---|
| | | Dow-Corning-Polysiloxane Viscosity of the base oil | | DuPont Perfluoro Oil |
| Examples | 1,000 cSt | 10,000 cSt | 30,000 cSt | 1,600 cSt |
| 1. Bissalicylaldehyde Ethylenediamine | S-C06687-2* (14A) | S-C06687-2* (14B) | S-C06687-2* (15A) | S-C06687-2* (17A) |
| 2. Cu Chelate of (1) | S-C06687-2* (14C) | S-C06687-2* (14D) | S-C06687-2* (15B) | S-C06687-2* (17B) |
| 3. Bissalicylaldehyde 1,3-Phenylenediamine | | S-C06687-2* (16C) | S-C06687-2* (15F) | S-C06687-2* (17C) |
| 4. Cu Chelate of (3) | — | S-C06687-2* (16D) | S-C06687-2* (15C) | S-C06687-2* (17D) |
| 5. Phthalocyanine | S-C06687-2* (14E) | S-C06687-2* (14F) | S-C06687-2* (15C) | S-C06687-2* (17E) |
| 6. Cu (III) Phthalocyanine | — | S-C06687-2* (16A) | S-C06687-2* (15D) | S-C06687-2* (17F) |
| 7. meso-TetraPhenyl Porphyrin | — | S-C06687-2* (16B) | S-C06687-2* (15E) | S-C06687-2* (17C) |

NOTE:
Each of the formulation listed above consists of a 10 (w/w) dispersion of the compound(s) in the base oil; *sample identification numbers of the different formulations.

A high-speed bearing test was designed and fabricated for evaluating high temperature lubricants in a dynamic environment. The fabricated machine was designed to test greases under a high stress (50 lb. thrust load, 25 lb. radial load, high speed at 10000 rpm, high temperatures at 200° C.). These conditions allow a more real evaluation of the benefits of the lubricating additives.

The wear-test procedure includes mixing the Schiff base product with 5 ml's of lubricant, loading the lubricant into the block and coupling assembly and installed in the high speed bearing test. The system assembly is completed, extensometers zeroed, chart recorder turned on and the clock rezeroed. The motors turned on followed by heating the block. The system is allowed to operate in this mode for about 30 minutes to allow the unit to come to equilibrium. The bearing is then loaded with 25 lbs. thrust load and 25 lbs. radial load. The current meter is set to a value of 5 amps above steady state current after a sample is loaded. The test is considered complete when the unit shuts down either because of current draw or by the vibration switch. At the completion of the test, the test time is recorded and the bearing removed from the machine. The bearing is examined for signs of wear. The bearing is sectioned and removed for the eight balls for micrometric analysis. The bearings for micrometric analysis are cleaned with acetone followed by soap and water to remove any surface deposits. The bearing diameters are measured, recorded and observed for their surface quality.

A total of 29 tests were carried out in the high speed bearing tester. The data generated from the test is presented in Table III.

TABLE III

Data From High Speed (10,000 rpm) High Temperature (200° C.) Bearing Testing (1)

| Bearing No. | Grease Tested | Test Time, (hr) |
|---|---|---|
| 1 (2) | Dry (No Load) | 1.3 |
| 2 (2) | MIL-C-10924E with additives | 7.7 |
| 3 (2) | MIL-C-10924E with additives | 4.1 |
| 4 (2) | MIL-C-10924E with additives (No Load) | 2.6 |
| 10 | MIL-C-10924E with additives | 22 |
| 11 | Dry | 2 |
| 12 | Type-W | 32 |
| 14 | Type-X | 6 |
| 15 | Type-Y | 4.3 |
| 16 | Type-AA | 8.6 |
| 17 | Type-W | 14.95 |
| 18 | Type-X | 6.3 |
| 19 | Type-Y | 17.7 |
| 20 | Type-AA | 36.8 |
| 21 | Type-W | 17.6 |
| 22 | Type-X | 8.9 |
| 23 | Type-Y | 14.2 |
| 24 | Type-AA | 34.8 |
| 30 | MIL-C-10924E with additives | 48 |
| 32 | MIL-C-10924E with additives | 32.4 |
| 33 | Type-Z | 35.5 |
| 35 | Type-Z | 31.2 |
| 36 | Type-W modified | 95 |

(1) Standard test conditions are 50 lb thrust and 25 lb radial loads with 5 ml of grease
(2) Fafnir bearing used in these tests all other work with SKF unit
(3) Test stopped before complete failure
Type-W = Salicylaldehyde + Ethylenediamine in Polysiloxane oil
Type-X = Copper Chelate of Salicylaldehyde + Ethylenediamine in Polysiloxane oil
Type-Y = Phthalocyanine in Polysiloxane oil
Type-Z = Copper chelate of Phthalocyanine in Polysiloxane oil
Type-AA = Meso – Tetraphenyl Porphyrin in Polysiloxane oil
Type-W-modified = 5% Salicylaldehyde – Ethylenediamine compound mixed with MIL-C-10924E without additives.

As shown by the data in Table III, the lubricant formulations i.e. grease composition including Schiff base compounds and their metal chelates, i.e. copper and zinc chelates were found to exhibit highly satisfactory corrosion protection and wear resistance (lubricity) at temperatures as high as 200° C. These results compare very favorably with commercial lubricants.

The data in Tables IV and V, show that 5% of the Schiff base (Example I in Table II) substantially improves the reduction in wear and increases the life of the bearings.

TABLE IV

204 Bearing Tests (M-50 Steel) (500° F. Bearing Performance Life, Hours)

| Sample | Bearing Unit No. 1 | 2 | Avg. | % Increase In Life |
|---|---|---|---|---|
| Krytox | 254 | 388 | 321 | — |
| Krytox + 5% Bissalicylaldehyde Ethylenediamine | 300 | 444 | 372 | 16 |

TABLE V

FOUR BALL WEAR TESTS (40 Kg Load, 1,200 RPM, 52100 Steel Balls, 167 F.)

| SAMPLE | WEAR SCAR DIAMETER (mm) | % REDUCTION IN WEAR |
|---|---|---|
| Grease | | |
| Krytox | 1.57 | — |
| +5% Bissalicylaldehyde Ethylenediamine | 1.18 | +25 |
| Polyalpha Olefin Oil/ Clay Thickened Grease | 1.03 | — |
| +5% Bissalicylaldehyde Ethylenediamine | 0.81 | +21 |

*NOTE:
Krytox is the fluorinated oil grease from DuPont Co.

The lubricating oil grease additives are prepared by reacting a polyamine such as an aryl polyamine or an alkylene polyamine e.g. benzidine or ethylene diamine, respectively with the carbonyl group of an aliphatic or aromatic aldehyde to form Schiff base derivatives. Generally, the polyamines are reacted with the aldehydes at approximately stoichiometric amounts i.e. at a mol. ratio of about 0.5 mol. of the diamine for each carbonyl group of the aldehyde or about 1.0 chemical equivalent of the diamine for each chemical equivalent of carbonyl group of the aldehyde. These reactions generally take place at temperatures ranging from about 140° to 350° F. or at a more narrow range from about 180° to 225° F. The reaction time will depend to some extent upon the reaction temperature. The degree of reaction can be determined by measuring the amount of water split-off during the reaction. In this regard, it is advisable to employ a water entraining solvent such as heptane or toluene, etc. to remove the water as it is formed during the reaction as an azeotrope. The total reaction time, to obtain the Schiff base, may range anywhere from 1 to 15 hours and more likely from 3 to 10 hours depending on the particular reaction conditions and particularly on the temperature of the reaction.

Generally, compounds derived from the reaction of aldehydes and polyamines are identified as Schiff bases having the formula:

$$R-Ar=\overset{R_1}{\overset{|}{C}}-N(CH_2\overset{R_2}{\overset{|}{C}}H-NH)_xH$$

wherein R is selected from the group consisting of hydrogen and aliphatic hydrocarbon components having from about 4 to 24 carbon atoms; Ar is an aromatic group derived from an aromatic hydrocarbon of the group consisting of benzene or naphthalene; $R_1$ is selected from the group consisting of hydrogen, alkyl components of 1 to 12 carbon atoms, aralkyl components of 4 to 12 carbon atoms and alkylene components of 4 to 18 carbon atoms; $R_2$ is selected from the group consisting of hydrogen and alkyl groups having 1 to 6 carbon atoms and X is a number ranging from 1 to 12.

The alkylene polyamines or aliphatic polyamines useful for preparing the Schiff base reaction compounds may be characterized as amino compounds containing from about 2 to 12 nitrogen atoms wherein pairs of the nitrogen atoms are joined by an alkyl or alkylene groups having from 2 to 4 carbon atoms. In addition, mixtures of the alkylene polyamines and alkyl amines may be used in preparing the Schiff base reaction products. Some of the preferred polyamines include diethylene triamine, tetraethylene pentamine, dibutylene triamine, dipropylene triamine, tetrapropylene pentamine, and various other aliphatic polyamines such as the amino alkyl-piperazine including aminoethyl piperazine, aminoisopropyl piperazine, etc. Other alkyl amino compounds include the dialkylamino alkylamines, dimethylamino methyl amine, dimethylamino propyl amine, methylpropyl aminoamyl amine, etc. The alkyl or alkylene amines may be characterized by the formula:

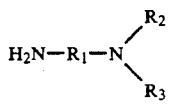

wherein $R_1$ is an alkyl or alkylene radical such as ethyl or ethylene, propyl or propylene, butyl or butylene, etc. and $R_2$ and $R_3$ are alkyl radicals having 1 to 8 carbon atoms.

The organic carbonyl compound i.e. aldehydes may be a saturated or unsaturated aldehyde. The following are representative examples which includes the aliphatic aldehydes, such as acetaldehyde, propionaldehyde, butyraldehyde, caproaldehyde, acrolein, croton aldehyde, ethyl butyraldehyde, ethyl propylaldehyde, heptaldehyde, etc. The aromatic aldehydes include benzaldehyde, salicylaldehyde, naphthaldehyde, phenylacetaldehyde, laurylbenzaldehyde, etc.

The lubricating oil greases to which the Schiff base products are added, as corrosion-inhibitors and anti-wear agents, are known synthetic lubricating oil greases. These greases are prepared by thickening the oil with well known materials such as silica gel etc. or an organic thickener or gelling agent. The synthetic oils used to prepare the greases in accordance with prior art methods include the synthetic lubricating oils such as the dibasic acid esters e.g. di-2-ethyl hexyl sebacate, the carbonate esters, the phosphate esters, the halogenated hydrocarbons, the polysilicones, the siloxanes e.g. silicone esters, the polyglycols, glycol esters, and complex esters derived from dibasic acids such as sebaic acid and polyglycols. The Schiff base reaction products, which generally are not soluble in these synthetic oils, are added to the synthetic lubricating oil greases in amounts ranging from about 0.01 to about 5.0% and preferably in amounts from about 0.1 to about 3.0% by weight of the grease.

It is obvious that there are other variations and modifications which can be made with respect to this invention without departing from the spirit and scope of the invention as particularly set forth in the appendant claims.

We claim:

1. A synthetic lubricating oil grease having improved corrosion-resistance and anti-wear properties comprising a major amount of a synthetic lubricating oil grease and about 0.01 to 5.0 percent by weight of said grease of a zinc or copper chelate of a Schiff base derived from the condensation of approximately stoichiometic amounts of at least one aromatic aldehyde and a polyamine.

2. The synthetic lubricating oil grease of claim 1 wherein the grease is a polysiloxane grease and the chelate of the Schiff base is a copper chelate.

3. The synthetic lubricating oil grease of claim 1 wherein the chelate of the Schiff base is a zinc chelate.

4. The synthetic lubricating oil grease of claim 2 wherein the aldehyde is an aromatic aldehyde and the polyamine is an aromatic diamine.

5. The synthetic lubricating oil grease of claim 2 wherein the grease is a fluorinated oil grease and the aromatic aldehyde is salicylaldehyde and the polyamine is ethylenediamine.

6. A method of improving the corrosion resistance and anti-wear properties of synthetic lubricating oil greases which comprises adding to said greases from about 0.1 to 3.0 percent by weight of said grease of a zinc or copper chelate of a Schiff base derived the condensation of approximately stoichiometic amounts of at least one aromatic aldehyde and a polyamine.

7. The method of claim 6 wherein the aldehyde is an aromatic aldehyde and the polyamine is an aromatic diamine.

8. The method of claim 6 wherein the metal chelate is a copper chelate derived from salicylaldehyde and ethylenediamine.

* * * * *

UNITED STATES PATENT AND TRADEMARK OFFICE

CERTIFICATE OF CORRECTION

PATENT NO. : 5,147,567

DATED : Sep. 15, 1992

INVENTOR(S) : Vinod S. Agarwala et al.

It is certified that error appears in the above-identified patent and that said Letters Patent are hereby corrected as shown below:

On the title page: Item [21]

"Apr. 9, 1971" should read

--Apr. 9, 1991--

Signed and Sealed this

Twenty-second Day of March, 1994

*Attest:*

Bruce Lehman

BRUCE LEHMAN

*Attesting Officer*

*Commissioner of Patents and Trademarks*